US005548316A

United States Patent [19]

Hamada et al.

[11] Patent Number: 5,548,316

[45] Date of Patent: Aug. 20, 1996

[54] STEREOSCOPIC IMAGE PROCESSING SYSTEM

[75] Inventors: Yasunori Hamada, Tsuchiura; Masataka Kawauchi, Nishinomiya, both of Japan

[73] Assignee: Hitachi, Ltd., Tokyo, Japan

[21] Appl. No.: 24,230

[22] Filed: Mar. 1, 1993

[30] Foreign Application Priority Data

| | | | |
|---|---|---|---|
| Feb. 27, 1992 | [JP] | Japan | 4-040954 |
| Feb. 27, 1992 | [JP] | Japan | 4-040955 |
| Feb. 27, 1992 | [JP] | Japan | 4-040956 |

[51] Int. Cl.[6] ..... B41J 2/32

[52] U.S. Cl. ..... 347/171; 358/471; 347/221

[58] Field of Search ..... 346/135.1; 347/171, 347/221; 358/471, 472

[56] References Cited

FOREIGN PATENT DOCUMENTS

| | | |
|---|---|---|
| 0030891 | 3/1981 | Japan . |
| 0138192 | 6/1991 | Japan . |

*Primary Examiner*—Huan H. Tran

*Attorney, Agent, or Firm*—Antonelli, Terry, Stout & Kraus

[57] ABSTRACT

A stereoscopic image processing system is disclosed, in which there are provided a first conveyance passage including conveying rollers for conveying a medium having a nature that the volume thereof expands when heated, a stereoscopic image output device including a heating head and a roller for pressing the medium against the heating head so as to heat the medium thereby to form a stereoscopic image, and an information processing control section for processing information of respective parts of the processing system and controlling operation thereof.

10 Claims, 10 Drawing Sheets

STEREOSCOPIC IMAGE PROCESSING SYSTEM

BACKGROUND OF THE INVENTION

1. Field of the Invention

The present invention relates to a stereoscopic image processing system which is capable of outputting an output of an information system directly onto a medium such as a blank form, reading the stereoscopic image recorded on the medium, making an exchange between a print image and the stereoscopic image, and further capable of facsimile for transferring the stereoscopic image to other equipment and copying of the stereoscopic image.

2. Description of the Related Art

In a conventional stereoscopic image output device, as described in JP-A-56-30891, an electric current is applied locally to a sheet having a nature that the volume thereof is increased irreversibly by expansion when heated, and the conductibility is similarly increased simultaneously thereby to heat the sheet locally by generation of heat caused by electric resistance of the same so as to expand the sheet, thus forming a stereoscopic image on the sheet.

According to this system, the equipment becomes large in size due to the necessity of electrodes on both sides of the sheet, and no consideration has been given as to obtain a fine stereoscopic image due to the fact that electrodes are required. Moreover, no consideration has been given to reading a stereoscopic image and in addition to the exchange between a print image and a stereoscopic image.

SUMMARY OF THE INVENTION

It is an object of the present invention to output an output from an information device directly to a medium such as a blank form having a nature that the volume thereof is increased irreversibly by expansion when heated with a stereoscopic image and also to make it possible to read a stereoscopic image and convert the same into electric signals.

Further, it is another object of the present invention to make possible stereoscopic image facsimile for reading a stereoscopic image directly and transmitting this information so as to output the information on other equipment as a stereoscopic image or copying a stereoscopic image.

Also, the system of the present invention has a further object to read a print image and convert this image into a stereoscopic image, or conversely to read a stereoscopic image and output the same after converting this image into a print image.

The objects described above can be achieved by providing stereoscopic image output means for outputting a stereoscopic image, stereoscopic image read means for reading a stereoscopic image, transfer means for exchanging information with other equipment, and information processing control means for processing information of respective means and controlling the operation of respective means.

Further, the system of the present invention can be achieved by providing stereoscopic image output means for outputting a stereoscopic image, stereoscopic image read means for reading a stereoscopic image, print image read means for reading a print image printed on a medium, print image output means for printing a print image on a medium for printing and information processing control means for processing information of respective means and controlling the operation of respective means.

In order to form a stereoscopic image on a medium such as a blank form in the system of the present invention, a medium such as a blank form having a nature that the volume thereof is increased irreversibly by expansion when heated is set, heating temperature of heating means is set by temperature setting means in accordance to a medium to be used, and the medium is heated by heating means having a plurality of heating members, thereby to make it possible to form a stereoscopic image on a blank form.

In order to read a stereoscopic image formed on a medium, a light emitting section composed of a light source, lenses for forming a light source image on a medium, and a mirror which is driven by a motor for traversing the light source image on the medium is lighted, a surface on which the stereoscopic image is formed is irradiated successively, and a spot image of the light source on the surface is formed on a sensor section by optical means composed of two cylindrical lenses, thus making it possible to convert the image into electric signals in accordance with the unevenness of the stereoscopic image formed on the medium so as to read the stereoscopic image.

Further, in order to send a stereoscopic image formed on a medium to other equipment and receive the stereoscopic image from other equipment such as with a facsimile machine, the stereoscopic image on the medium is read first, and the electric signals thereof are sent to other equipment by transmission means. As described above, on the other hand, it is possible to receive electric signals from other equipment which are sent from the transmission means and form a stereoscopic image as described above. It is also possible to realize the function of facsimile for transmitting a stereoscopic image formed on a medium among equipment by providing the equipment described above as other equipment.

Further, as to a function for copying a stereoscopic image formed on a medium, it is possible to copy a stereoscopic image by reading the stereoscopic image on the medium and receiving electric signals thereof, thereby to form a stereoscopic image as described above.

Further, when a print image is read and a stereoscopic image is output, a print image printed on a print medium is read first by print image read means, and character information is recognized and sent to stereoscopic image output means. In the stereoscopic image output means, it is possible to form a stereoscopic image on a medium having a nature that the volume thereof is increased irreversibly by expansion when heated by heating the medium with heating means having a plurality of heating members in which a heating temperature of heating means in accordance with a medium to be used is set by temperature setting means. In addition, it is also possible to send information to other equipment by transmission means, and to form a stereoscopic image on a medium in that equipment.

Further, when a stereoscopic image is read and a print image is output, it is possible to read the unevenness on a stereoscopic image formed on a medium by stereoscopic image read means first, and then print a print image on a print medium by print image output means. It is also possible to send information to other equipment through transmission means and print a print image on a print medium in that equipment.

DESCRIPTION OF THE PREFERRED EMBODIMENTS

Figure 4:
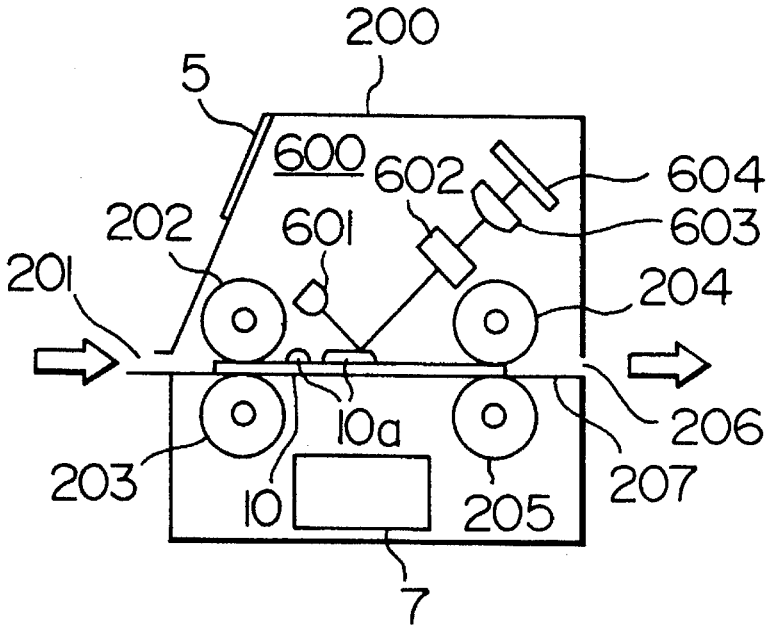
FIG. 4 is a sectional view showing an example of a stereoscopic image reader of the present invention.
Figure 5:
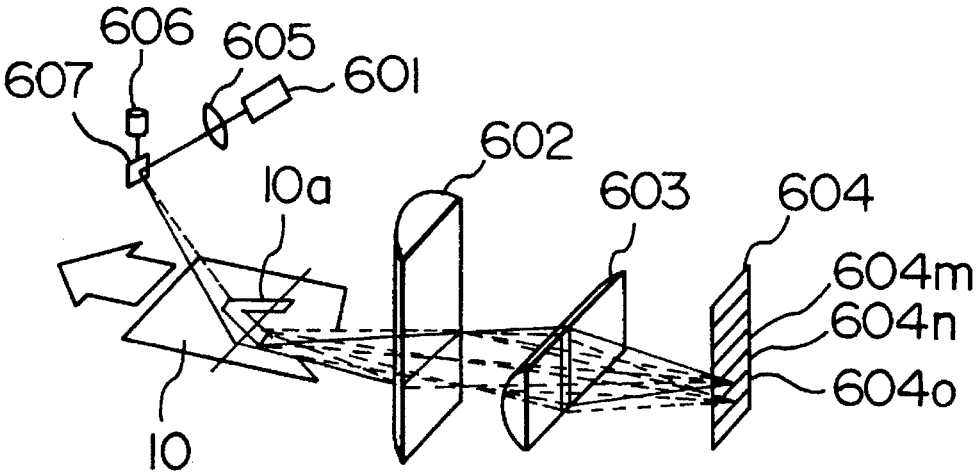
FIG. 5 is an explanatory view showing an example of an optical system of a stereoscopic image reader in FIG. 4.

An embodiment of an output unit of a stereoscopic image of the present invention will be described with reference to FIG. 1 to FIG. 3, and an embodiment of a reader of a stereoscopic image will be described with reference to FIG. 4 to FIG. 6.

First, an embodiment of an output unit of a stereoscopic image will be described. FIG. 1 is a sectional view of a stereoscopic image output unit of the present invention, FIG. 2 is an explanatory diagram showing an example of a structure of a stereoscopic image output section of the stereoscopic image output unit, and FIG. 3 is a block diagram of an information processing control section for controlling the stereoscopic image output unit.

In an output unit 100, there is provided a display operation section 5 for showing directional display on operation for a user or inputting information of the user. Blank forms 11 as media are those blank forms that have such a nature that the volume thereof is increased by expansion when heated. A hopper 101 which is a housing section is provided for piling up new blank forms 11. In the hopper 101, there is provided a separating section 110 composed of a gate roller 112, a feed roller 113 and a pickup roller 111, so as to take out the blank forms 11 in the hopper 101 one sheet at a time. In the separating section 110, there is provided a first conveyance passage 107 as a first conveying means having conveying rollers 102, 103, 104 and 105 for conveying a blank form 10 taken out of the hopper 101. Along this first conveyance passage 107, there are provided a stereoscopic image output section 50 for heating the blank form 10 so as to form a stereoscopic image, and a roller 108 as pressing means for pressing the blank form 10 against the stereoscopic image output section 50 facing to the stereoscopic image output section 50. A blank form releasing port 106 is provided on a side opposite to the separating section 110 along the first conveyance passage 107 so that the blank form may be released. Furthermore, there is provided an information processing control section 7 for controlling respective sections and/or processing information.

Figure 1:
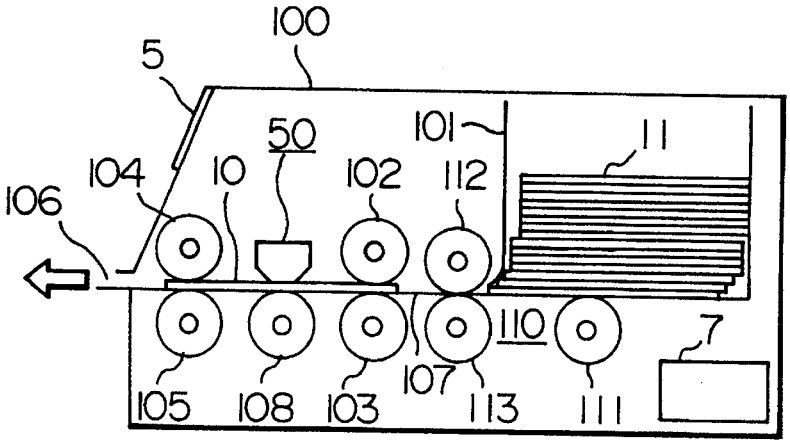
FIG. 1 is a sectional view showing an example of a stereoscopic image output unit of the present invention.
Figure 2:
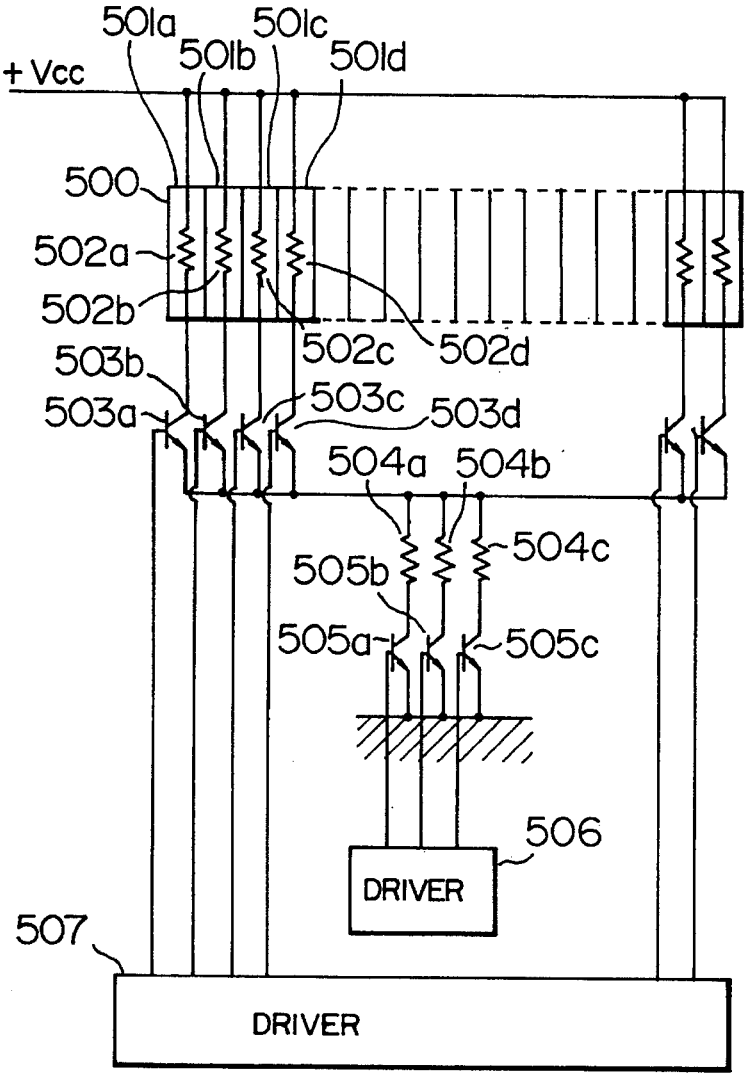
FIG. 2 is an explanatory diagram showing an example of a structure of an image output section in FIG. 1.

FIG. 2 is an explanatory diagram showing an example of the stereoscopic image output section 50 shown in FIG. 1. A heating head 500 is formed of a plurality of heating cells 501*a*, 501*b*, 501*c*, 501*d* and so on having heating means by heating members, respectively, and the size of each heating cell is one that a plurality of heating cells are included in one character size. Namely, one character is printed by means of a plurality of heating cells. Since the structure of respective heating cells 501*a*, 501*b*, 501*c*, 501*d* and so on is the same, description will be made with respect to the heating cell 501*a*. A heater 502*a* which is heating means is provided in the heating cell 501*a*. One side of this heater 502*a* is connected to a power source, and the other side thereof is connected to a collector terminal of a transistor 503*a* controlling conduction quantity to the heater 502*a*. An emitter terminal of the transistor 503*a* is connected to resistors 504*a*, 504*b* and 504*c*, and a base terminal thereof is connected to a driver 507, thus controlling the operation of the transistor 503*a*. The resistors 504*a*, 504*b* and 504*c* are connected to collector terminals of transistors 505*a*, 505*b* and 505*c*, respectively. The transistors 505*a*, 505*b* and 505*c* are for controlling the maximum conduction quantity applied to respective heating cells 501*a*, 501*b*, 501*c*, 501*d* and so on, and are temperature setting means for setting the heating temperatures of the heating means. Respective emitter terminals of the transistors 505*a*, 505*b* and 505*c* are connected to a ground line, and respective base terminals thereof are connected to a driver 506. Namely, it is possible to obtain set heating temperatures by selecting the transistor 505*a*, 505*b* or 505*c* by means of a signal from the driver 506 so as to have it operate. Further, it is possible to vary the level of an output signal of the driver 506 so as to drive the transistors 505*a*, 505*b* and 505*c*, thereby to set to the heating temperature suitable for a set blank form. The drivers 506 and 507 are controlled by a stereoscopic image output control section 703 of an information processing control section 7 shown in FIG. 3.

Figure 3:
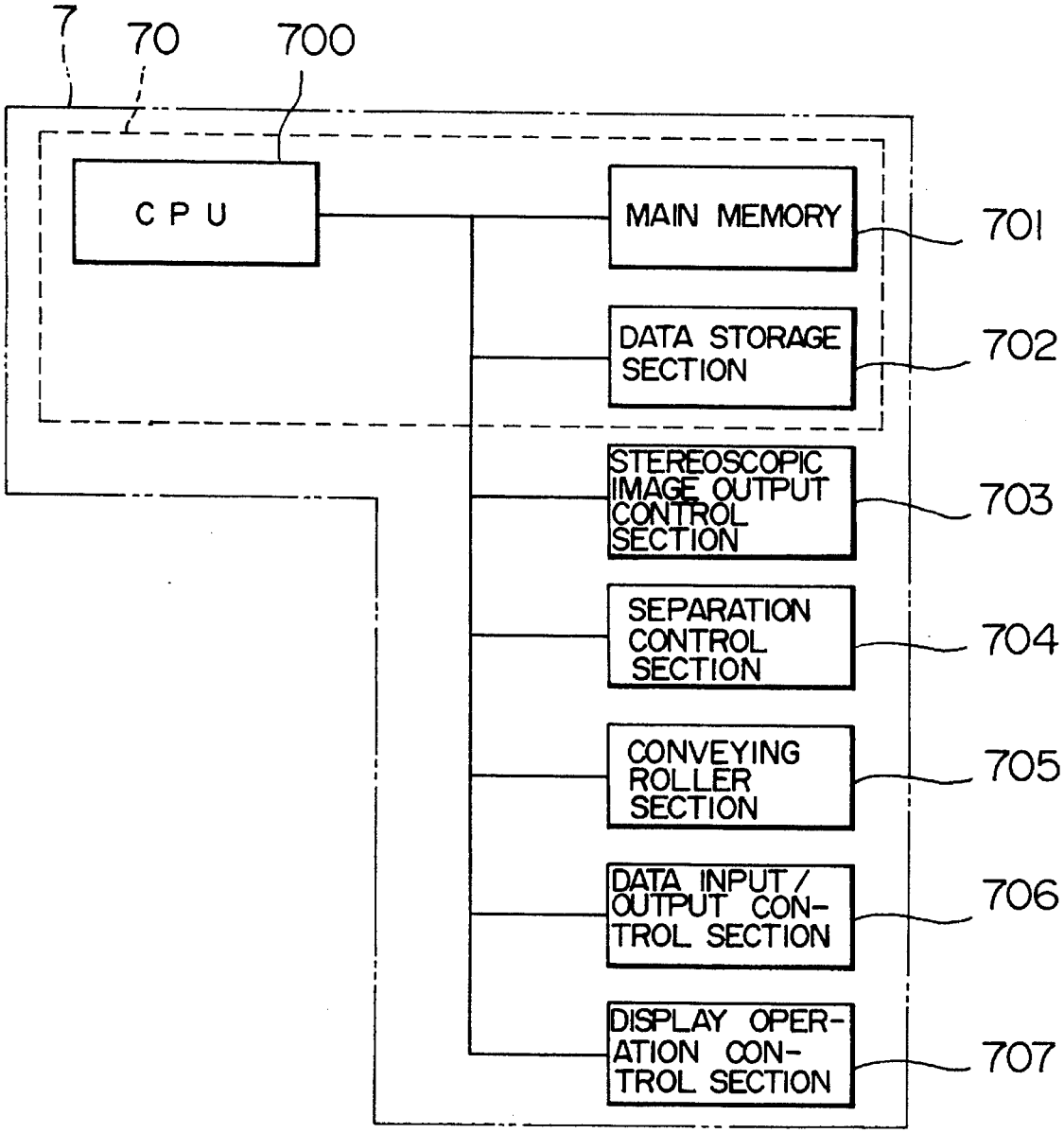
FIG. 3 is a block diagram showing an example of an information processing control section for controlling a stereoscopic image output unit shown in FIG. 1.

FIG. 3 is a block diagram showing an example of the information processing control section 7 for controlling the stereoscopic image output unit 100. The information processing control section 7 is composed of a stereoscopic image output control section 703 for controlling a stereoscopic image output section 50, a separation control section 704 for controlling a separating section 110 for separating the blank forms 11 one sheet at a time from the hopper 101, a conveying roller control section 705 for controlling the conveying rollers 102, 103, 104 and 105, a data input-output control section 706 for inputting data information on an output stereoscopic image, a display operation control section 707 for controlling the display operation section 5 for performing information display and operation input of the output unit 100, and a control section 70 for performing overall control on respective control sections. The control section 70 is composed of a CPU 700, a main memory 701 and a data storage section 702 for storing data.

Hereinafter, the operation of the output unit 100 of a stereoscopic image will be described. A user who requires an output inputs a type of the blank form to be used and then inputs start. In order to output a stereoscopic image onto a blank form in accordance with the start information, information from another information terminal is fetched into the data storage section 702 of the output unit 100 through the data input-output control section 706. Then, the separating section 110 and conveying rollers 102, 103, 104 and 105 start to operate, respectively, in accordance with control signals of the separation control section 704 and the conveying roller control section 705. The separating section 110 starts to operate, and one sheet of blank forms 11 set in the hopper 101 is taken out and is sent out to the conveyance passage 107. A sent out blank form 10 is sent to the stereoscopic image output section 50 and is pressed against the stereoscopic image output section 50 by means of the roller 108 and is thereby heated.

On the other hand, in order to obtain a heating temperature which is set in accordance with the blank form to be used, the driver 506 is controlled from the stereoscopic image output control section 703, and the transistor 505*a*, 505*b* or 505*c* is selected so as to be operated by the output of the driver 506. The information stored in the data storage section 702 is sent to the stereoscopic image output control section 703 consecutively, selects a heating cell to be heated and controls the driver 507, and selects transistor 503*a*, 503*b*, 503*c*, 503*d* or the like so as to have it operate. With this, heaters 502*a*, 502*b*, 502*c*, 502*d* and so on connected to transistors in operation are heated. In this state, the blank form 10 is heated at a position in accordance with output information, and the heated part is expanded thereby to increase the volume thereof irreversibly, thus forming a stereoscopic image. The blank form on which a stereoscopic image is thus formed is sent to the blank form releasing port 106 by means of conveying rollers 104 and 105 so as to be released to a user client.

According to the embodiment described above, it is possible to form a stereoscopic image on a blank form by partially heating a blank form that has such a nature that the volume thereof is increased irreversibly by expansion when heated.

In the present embodiment, an example that information for output is fetched from another information terminal has been explained, but similar effects are also obtainable when such a function is contained in the output unit 100.

Next, an embodiment of a reader of a stereoscopic image will be described with reference to FIG. 4 to FIG. 6. FIG. 4 is a sectional view showing an example of a stereoscopic image reader, FIG. 5 is an explanatory view showing an example of an optical system of a stereoscopic image reader, and FIG. 6 is a block diagram showing an example of an information processing control section for controlling a stereoscopic image reader.

In a reader 200, there are provided a display operation section 5 for showing directional display of operation for a user and inputting information of the user, a charging port 201 for charging the blank form 10 on which a stereoscopic image is formed, and an information processing control section 7 for controlling respective sections and/or processing information. The charging port 201 is provided at one end of a second conveyance passage 207 as a second conveying means having conveying rollers 202, 203, 204 and 205 for conveying the blank form 10, and a blank form releasing port 206 is provided at the other end thereof. Further, a stereoscopic image reader section 600 for detecting a projection 10*a* formed on the blank form 10 is provided along the second conveyance passage 207. This stereoscopic image reader section 600 is composed of a light source 601, a first lens 602, a second lens 603, a sensor section 604, a lens 605, a motor 606 and a mirror 607.

Next, the details of the stereoscopic image reader section 600 will be described with reference to an explanatory view of an optical system shown in FIG. 5. The light source 601 and the lens 605 are arranged so as to form an image on the blank form 10 through the mirror 607. The mirror 607 is driven by the motor 606, and is set so that an image may be traversed successively from an end surface of the blank form 10 to another end surface of the blank form 10 through the top of the blank form 10. Further, the first lens 602 and the second lens 603 are composed of cylindrical lenses which make a right angle with each other, respectively, and it is arranged so that the first lens 602 forms images formed consecutively on the blank form 10 in a horizontal direction and the second lens 603 forms images in a vertical direction on the sensor section 604. The sensor section 604 includes a plurality of sensor elements 604*m*, 604*n* and 604*o*. If the image of the light source except for the case of the projection 10*a* of the blank form 10 has been detected by the sensor element 604*n*, the image of the light source for the case of the projection 10*a* is detected by the sensor element 604*o* for instance, thus making it possible to detect the unevenness of the blank form 10.

Figure 6:
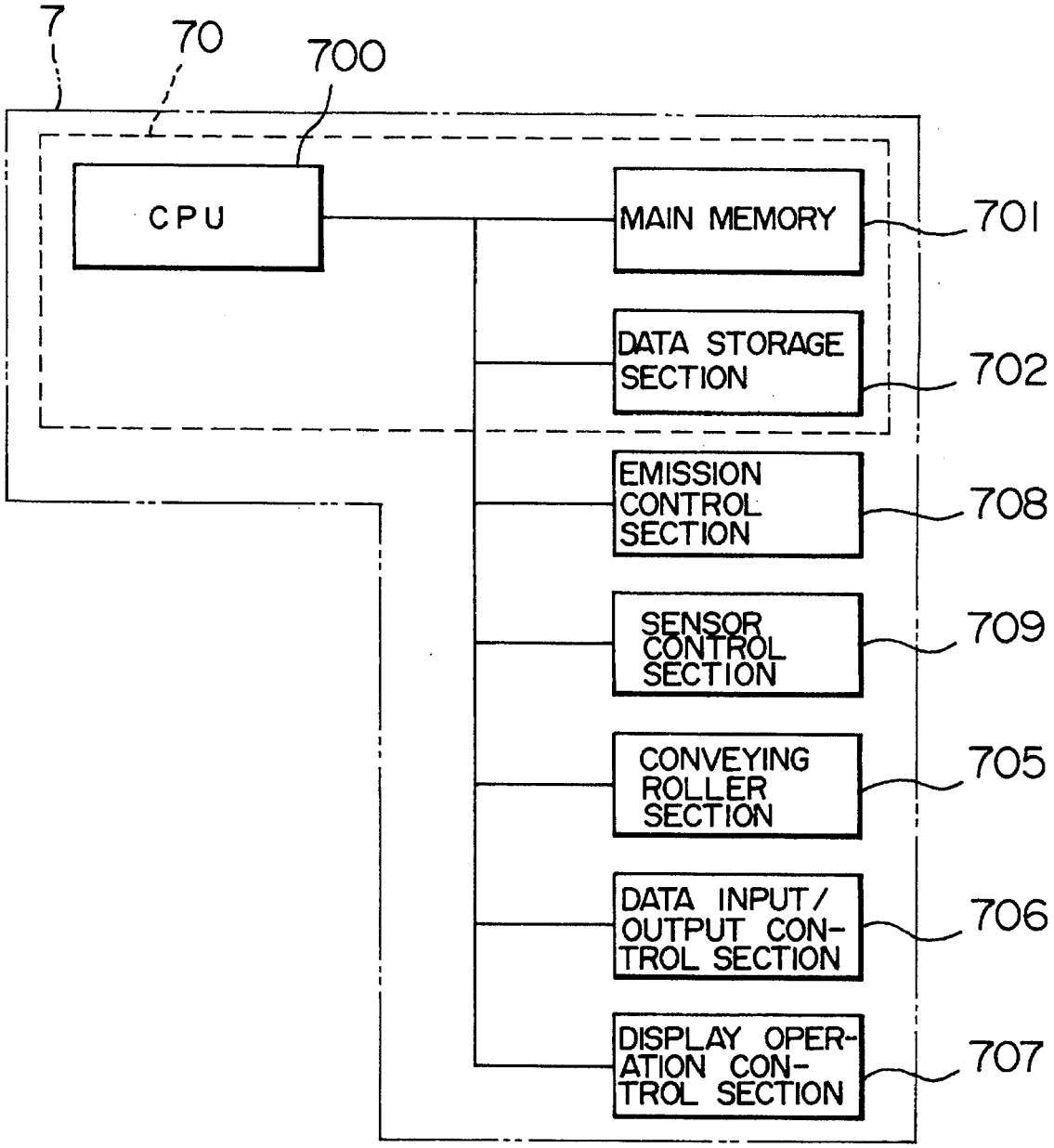
FIG. 6 is a block diagram showing an example of an information processing control section for controlling the stereoscopic image reader shown in FIG. 4.

FIG. 6 is a block diagram showing an example of the information processing control section 7 for controlling the stereoscopic image reader 200. The information processing control section 7 is composed of a light emission control section 708 for controlling the light source 601 and the motor 606 of the stereoscopic image reader section 600, a sensor control section 709 for controlling the sensor section 604 of the stereoscopic image reader section 600, a conveying roller control section 705 for controlling conveying rollers 202, 203, 204 and 205, a data input-output control section 706 for outputting the data information of the read stereoscopic image, a display operation control section 707 for controlling the display operation section 5 for performing information display and operation input of the reader 200, and a control section 70 for performing overall control on respective control sections. The control section 70 is composed of a CPU 700, a main memory 701 and a data storage section 702 for storing data.

Hereinafter, the operation of the reader 200 of a stereoscopic image will be described. When start of reading is instructed from the display operation section 5 of the reader 200, the conveying rollers 202, 203, 204 and 205 along the second conveyance passage 207 start to operate by means of control instructions of the conveying roller control section 705. When the blank form 10 on which a stereoscopic image is formed is charged into the charging port 201, the blank form 10 is taken in by means of the conveying rollers 202 and 203. When the blank form 10 is sent to the stereoscopic image reader section 600 provided along the second conveyance passage 207, the light source 601 is lighted by the control of the emission control section 708, and the mirror 607 is driven by the motor 606. Thus, light is first condensed by means of the lens 605 and reflected by the mirror 607, and the mirror 607 is set at an image forming position at the end portion of the blank form 10. The image formed on the blank form 10 is focused on any of a plurality of sensor elements 604*m*, 604*n*, 604*o* and so on of the sensor section 604 by means of the first lens 602 and the second lens 603. When the read signal from the sensor section 604 is sent to the data storage section 702, the motor 606 is driven so as to rotate the mirror 607, the position of the image on the blank form 10 is shifted, and the image is sent to the read data storage section 702 by the sensor section 604 in a similar manner. When reading at the sensor section 604 is completed while shifting the image to another end portion of the blank form 10 by rotating the mirror 607 as described above, the motor 606 is driven in a reverse manner and reading is performed while traversing the mirror 607 in a reverse direction, which is performed over the length and breadth of the blank form 10.

Next, reading of the projection 10*a* on the blank form 10 will be described. When it is assumed that the image of the light source except the case of the projection 10*a* on the blank form 10 is focused on the sensor element 604*n*, the signal detected from the sensor element 604*n* is stored in the data storage section 702 through the sensor control section 709, and the image of the light source in the case of the projection 10*a* on the blank form 10 is detected by the sensor elements other than the sensor element 604*n* in accordance with the height thereof, thereby to store the data thereof in the data storage section 702. The image on the blank form 10 is traversed by the mirror 607 while the blank form 10 is being sent, the image being detected by the sensor section 604, and the detected signals are stored in the data storage section 702 consecutively, thus making it possible to read the unevenness on the blank form 10. The read blank form 10 is released through the blank form releasing port 206, thus completing reading.

According to the embodiment of the present invention, it is possible to read a stereoscopic image formed on a blank form as electric signals successively.

Figure 7:
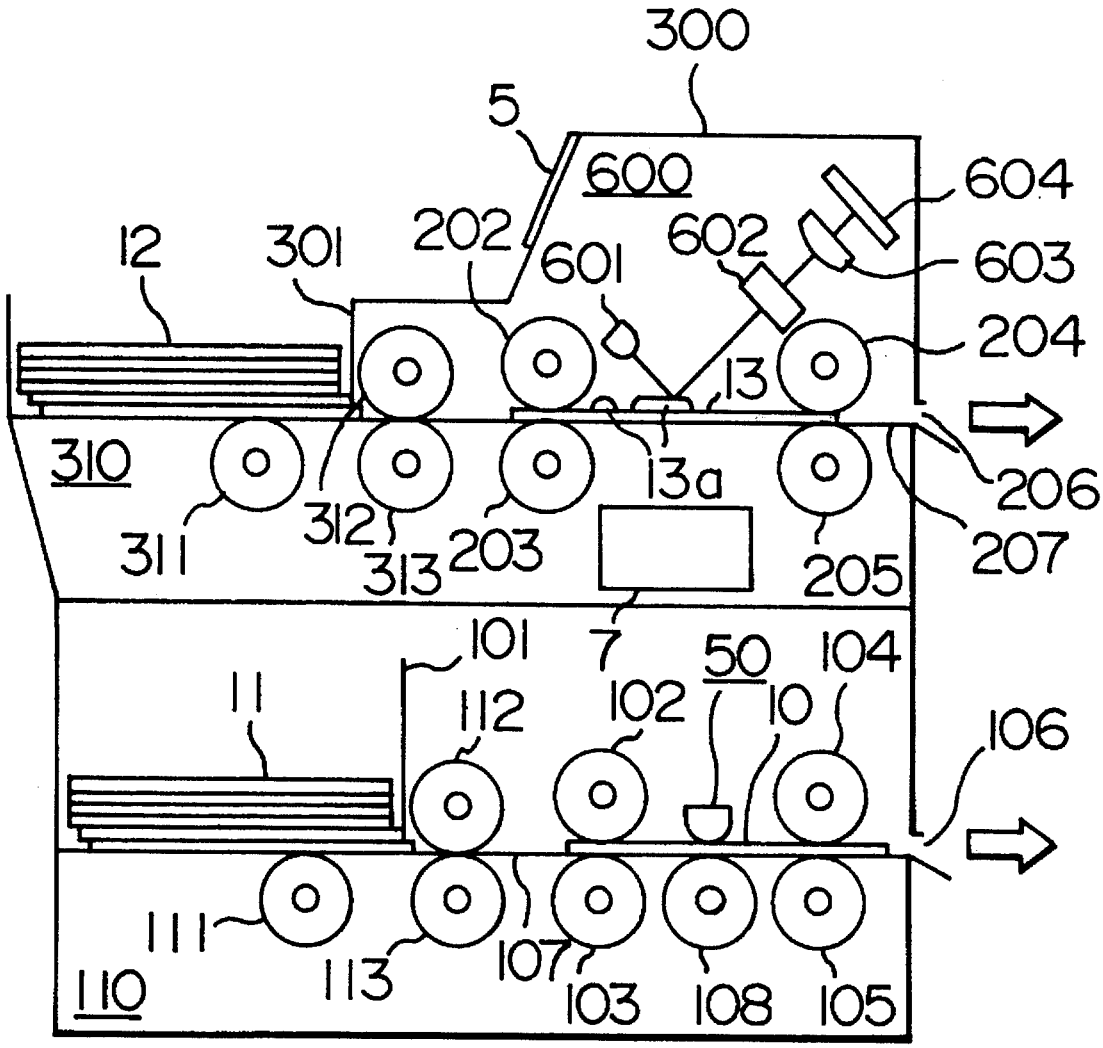
FIG. 7 is a sectional view showing an example of a stereoscopic image input-output unit of the present invention.

As described above, it has been explained that it is possible to output a stereoscopic image onto a blank form or to read a stereoscopic image on a blank form according to an embodiment of the present invention, but an example of a stereoscopic image input-output unit will be described with reference to FIG. 7 and FIG. 8 as an embodiment of a facsimile or copying unit of a stereoscopic image requiring both functions described above. FIG. 7 is a sectional view showing an example of a stereoscopic image input-output unit, and FIG. 8 is a block diagram showing an example of an information processing control section for controlling a stereoscopic image input-output unit.

In a stereoscopic image input-output unit 300 shown in FIG. 7, those elements that are the same as those in the embodiment described above are indicated by the same reference numerals, and new components will be described here. Blank forms 12 and 13 are those on which a stereoscopic image is formed, and the blank forms 12 are those set in a hopper 301 and the blank form 13 is one sent out to the second conveyance passage 207 by a separating section 310 of the hopper 301. It is arranged so that the separating section 310 of the hopper 301 can take out the blank forms 12 in the hopper 301 one sheet at a time by means of a gate roller 312, a feed roller 313 and a pickup roller 311. Further, blank forms 10 and 11 are those that have a nature that the volume thereof is increased irreversibly by expansion when heated, and the blank forms 11 are those that are accumulated in the hopper 101 and the blank form 10 is one that is sent out to a first conveyance passage 107. Furthermore, an information processing control section 7 is provided for controlling respective sections and/or processing information.

Figure 8:
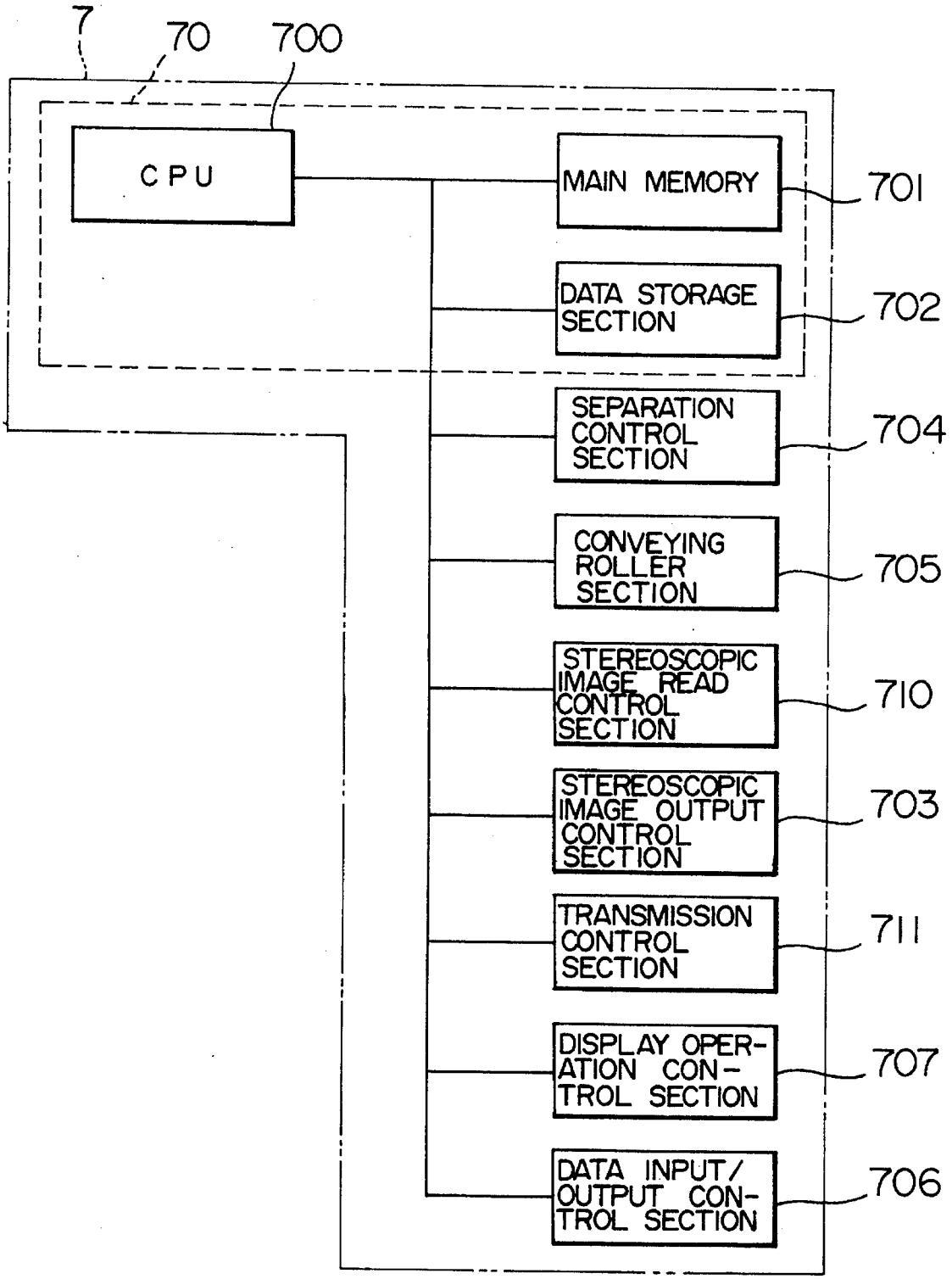
FIG. 8 is a block diagram showing an example of an information processing control section for controlling the stereoscopic image input-output unit shown in FIG. 7.

FIG. 8 is a block diagram of the information processing control section 7 for controlling the stereoscopic image input-output unit 300. This information processing control section 7 is composed of a separation control section 704 for controlling separating sections 110 and 310 for separating the blank forms 11 and 12 one sheet at a time from the hoppers 101 and 301, a conveying roller control section 705 for controlling conveying rollers 102, 103, 104 and 105 and conveying rollers 202, 203, 204 and 205, a stereoscopic image read control section 710 for controlling a light source 601, a motor 606 and a sensor section 604 that are components of a stereoscopic image reader section 600, a stereoscopic image output control section 703 for controlling a stereoscopic image output section 50, a transmission control section 711 for controlling data communication with another unit, a display operation control section 707 for controlling a display operation section 5 for performing information display and operation input for the input-output unit, a data input-output control section 706 for controlling data information on a stereoscopic image to be output and data information on a read stereoscopic image, and a control section 70 for performing overall control on respective control sections. The control section 70 is composed of a CPU 700, a main memory 701 and a data storage section 702 for storing data.

The operation of the input-output unit 300 of a stereoscopic image will be described hereinafter, starting first from the operation of reading a stereoscopic image and transmitting the same to another unit. When information on a transmission destination and read starting are instructed from the display operation section 5 of the input-output unit 300 of a stereoscopic image, the separating section 310 starts to operate by a control signal of the separation control section 704, and one sheet of the blank forms 12 set in the hopper 301 is taken out. The unevenness of the blank form 13 sent out to the second conveyance passage 207 is read by the stereoscopic image reader section 600 and stored in the data storage section 702. When reading of data is completed, the read information stored in the data storage section 702 is transmitted to another unit by a transmission control section 711. Since the operation of another unit which receives the read information is the same as the operation to output the information transmitted to the present unit, the output operation of the information transmitted to the present unit will be described. The transmitted information is stored in the data storage section 702 through the control by the transmission control section 711. When transmission is terminated, the separating section 110 of the hopper 101 is controlled by means of the separation control section 704, and one sheet of the blank forms 11 is taken out and sent to the stereoscopic image output section 50. The data stored in the data storage section 702 are sent to the stereoscopic image output control section 703, and a stereoscopic image is formed on the blank form 10 by the stereoscopic image output section 50.

As described above, it becomes possible to read a stereoscopic image and transmit the same to another unit according to the present embodiment. Further, since a stereoscopic image can be output by the transmission data from another unit, a facsimile function of a stereoscopic image can be realized.

In the embodiment described above, it has been explained that data are transmitted to another unit after storing the data in the data storage section 702, but it is also possible to transmit the data to another unit by means of the transmission control section 711 while reading the data directly, or to output a stereoscopic image while receiving transmission of information from another unit.

Further, it is also possible to perform what is called copying in which the read information is output as it is so as to form a stereoscopic image.

According to the foregoing description, it is possible to output the output from an information unit in the form of a stereoscopic image directly onto a blank form having a nature that the volume thereof is increased irreversibly by expansion when heated. Further, it is possible to read a stereoscopic image formed on a blank form and convert the image into electric signals. Moreover, it is possible to facsimile a stereoscopic image by directly reading the stereoscopic image and transmitting the information so as to output the same to another unit as a stereoscopic image or to copy a stereoscopic image.

Next, as another embodiment of the present invention, a unit capable of reading a print image and converting the same into a stereoscopic image, and conversely, reading a stereoscopic image and converting the same into a print image will be described.

Figure 9:
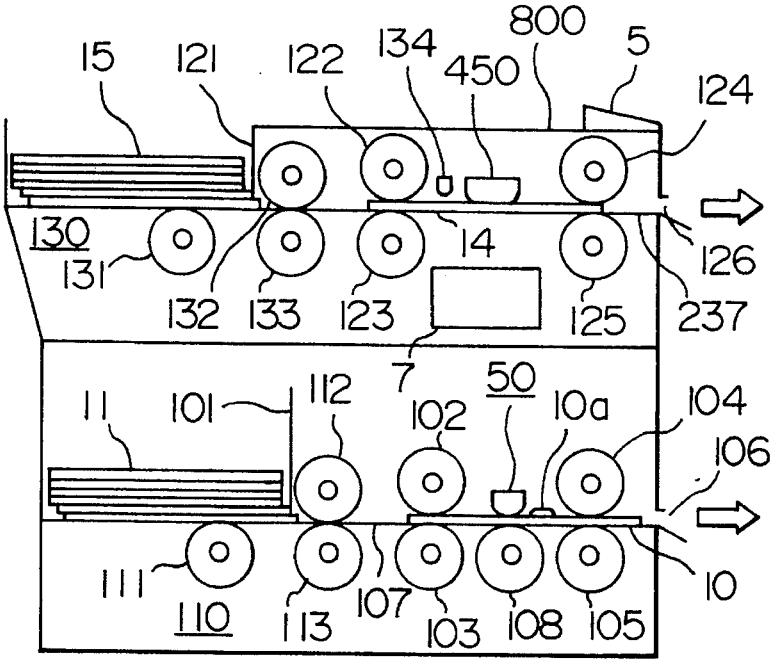
FIG. 9 is a sectional view showing an example of a conversion unit for converting a print image into a stereoscopic image according to the present invention.
Figure 10:
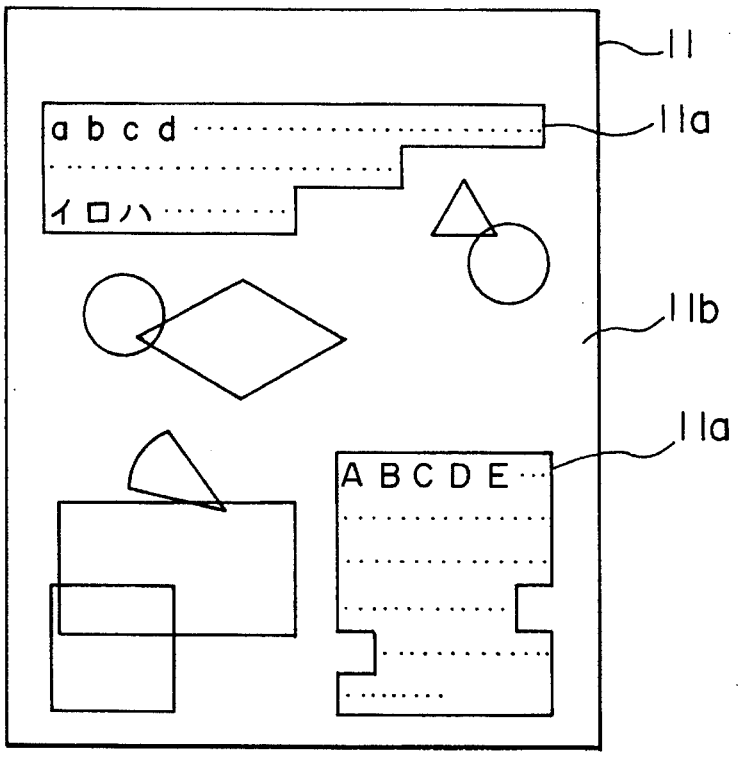
FIG. 10 is an explanatory diagram showing an example of a print format of a print image.
Figure 11:
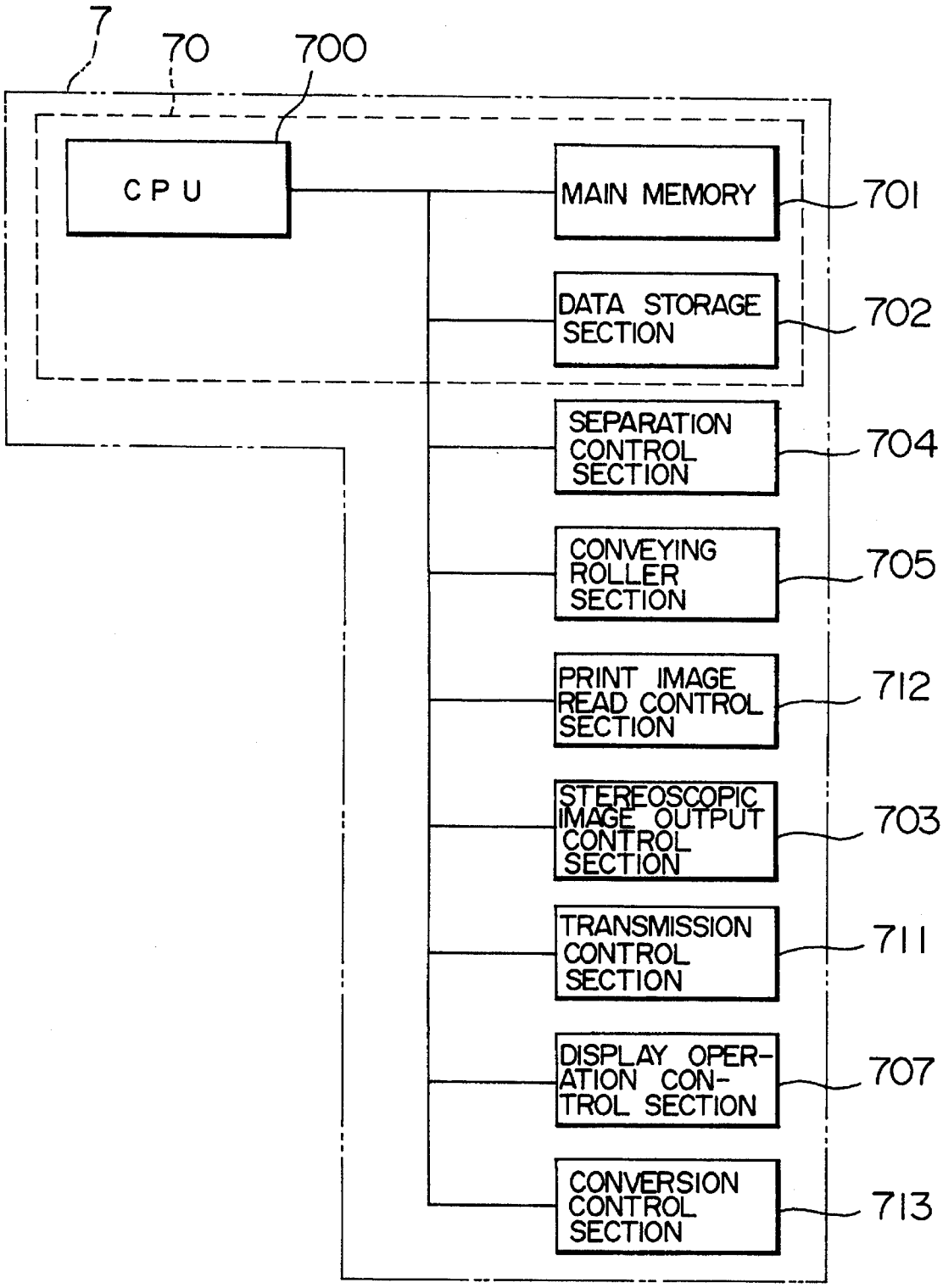
FIG. 11 is a block diagram showing an example of an information processing control section for controlling the conversion unit shown in FIG. 9.

First, an embodiment of an input-output unit of a stereoscopic image using a blank form on which a print image for instance is printed as a medium and outputting a stereoscopic image on a blank form as a medium will be described. FIG. 9 is a sectional view showing an example of a conversion unit for converting a print image into a stereoscopic image, FIG. 10 is an explanatory diagram showing an example of a print format of a print image, and FIG. 11 is a block diagram showing an example of an information processing control section for controlling the conversion unit shown in FIG. 9. In the description referring to FIG. 9, a case that a print image is printed on a blank form, which, however, is not limited thereto. In a conversion unit 800, there is provided a display operation section 5 for showing directional display of operation for a user and/or inputting information of the user.

First, a structure for reading a print image will be described. A hopper 121 which is a housing section is provided for accumulating blank forms 15 on which a print image is printed. In the hopper 121, there is provided a separating section 130 consisting of a gate roller 132, a feed roller 133 and a pickup roller 131, so that the blank forms 15 in the hopper 121 may be taken out one sheet at a time. In the separating section 130, there are provided a third conveyance passage 237 as a third conveying means having conveying rollers 122, 123, 124 and 125 for conveying a blank form 14 taken out of the hopper 121. Along this third conveyance passage 237, there are provided a detector sensor 134 for detecting a print format on the blank form 14 and a print image read section 450 for reading a print image printed on the blank form 14. Along the third conveyance passage 237, there is provided a blank form releasing port 126 on a side opposite to the separating section 130, so that the blank form may be released having been completely read.

Next, a structure for forming a stereoscopic image on a blank form will be described. The blank forms 11 are those that have such a nature that the volume thereof is increased irreversibly by expansion when heated, and a hopper 101 is provided for accumulating new blank forms 11. In the hopper 101, there is provided a separating section 110 consisting of a gate roller 112, a feed roller 113 and a pickup roller 111, so that the blank forms 11 in the hopper 101 may be taken out one sheet at a time. In the separating section 110, there is provided a first conveyance passage 107 as a first conveying means having conveying rollers 102, 103, 104 and 105 for conveying a blank form 10 taken out of the hopper 101. Along the first conveyance passage 107, there are provided a stereoscopic image output section 50 for heating the blank form 10 so as to form a stereoscopic image and a roller 108 as pressing means located opposite to the stereoscopic image output section 50 and for pressing the blank form 10 against the stereoscopic image output section 50. Along the first conveyance passage 107, there is provided a blank form releasing port 106 on the opposite side of the separating section 110, thereby to make it possible to release a blank form on which a stereoscopic image is formed.

Furthermore, there is provided an information processing control section 7 for controlling respective portions and/or processing the information. The above-described stereoscopic image output section 50 has the structure shown in FIG. 2.

FIG. 10 is an explanatory diagram of a print format of a print image. A print image printed on the blank form 11 consists of an area 11*a* for recognition where characters for converting into braille characters are printed and the other area 11*b* for no recognition, and respective areas are respectively designated by the display operation control section 5 before starting reading.

FIG. 11 is a block diagram of an example of the information processing control section 7 for controlling the conversion unit 800 shown in FIG. 9. The information processing control section 7 is composed of a separation control section 704 controlling the separating sections 110 and 130 for separating the blank forms 11 and 15 one sheet at a time from the respective hoppers 101 and 121, a conveying roller control section 705 for controlling the conveying rollers 122, 123, 124 and 125 along the third conveyance passage 237 and the conveying rollers 102, 103, 104 and 105 along the first conveyance passage 107, a print image read control section 712 for controlling a print image read section 450, a stereoscopic image output control section 703 for controlling the stereoscopic image output section 50, a transmission control section 711 for controlling data communication with other units, a display operation control section 707 for controlling the display operation section 5 for performing information display and operation input of the conversion unit, conversion means 713 for converting information in the area 11*a* for recognition among the information on a print image which has been read into braille characters, and a control section 70 for performing overall control on respective control sections. The control section 70 is composed of a CPU 700, a main memory 701, and a data storage section 702 for storing data.

The operation of the conversion unit 800 will be described hereinafter. A user who utilizes the conversion unit 800 designates the type of a blank form to be used and an area for recognition in a blank form for reading a print image from the display operation section 5 and inputs start. By virtue of the start information, the separating section 130 and the conveying rollers 122, 123, 124 and 125 start, respectively, by control signals of the separation control section 704 and the conveying roller control section 705 starting from the hopper 121 where the blank forms 15 on which a print image is printed are housed. The separating section 130 starts, and one sheet of the blank forms 15 which are set in the hopper 121 is taken out and sent to the conveyance passage 107. The sent out blank form 14 is sent to a detector sensor 134 by means of the conveying rollers 122 and 123, and the area 11*a* for recognition is detected by the detector sensor 134. Furthermore, the blank form 14 is sent to the print image read section 450, where the print image is read, and the read information is stored in the data storage section 702. The information detected by the detector sensor 134 to be the data in the area 11*a* for recognition among information stored in the data storage section 702 is converted into braille characters by the conversion means 713, which are stored in the data storage section 702 as the information on a stereoscopic image together with the information of the area 11*b* for no recognition. The blank form 14 having its print image completely read is released through the blank form releasing port 126. The blank forms to be read are separated by the separating section 130 successively, thus reading the information.

In order to output the information stored in the data storage section 702 as information on a stereoscopic image to a blank form as a stereoscopic image, the separating section 110 and the conveying rollers 102, 103, 104 and 105 start, respectively, by means of control signals from the separation control section 704 and the conveying roller control section 705. The separating section 110 starts, and one sheet of the blank forms 11 set in the hopper 101 is taken out and sent out to the first conveyance passage 107. The sent out blank form 10 is sent to the stereoscopic image output section 50 by means of the conveying rollers 102 and 103 and pressed against the stereoscopic image output section 50 by means of the roller 108, and is thereby heated.

On the other hand, in order to obtain a heating temperature which was set in accordance with the type of a blank form to be used, the driver 506 of the stereoscopic image output section 50 is controlled from the stereoscopic image output control section 703, and the transistor 505*a*, 505*b* or 505*c* is selected by the output of the driver 506 so as to operate. The information stored in the data storage section 702 is sent to the stereoscopic image output control section 703 consecutively, a heating cell to be heated is selected so as to control the driver 507, and selection is made among transistors 503*a*, 503*b*, 503*c*, 503*d* and so on, which is made to operate. With this, the heater 502*a*, 502*b*, 502*c*, 502*d* or the like connected to the transistor in operation is heated. In this state, the blank form 10 expands and increases the volume thereof irreversibly when heated at positions in accordance with the output information, thus forming a stereoscopic image. The blank form on which a stereoscopic image is thus formed is sent to the blank form releasing port 126 by means of conveying rollers 124 and 125, and released to a user client.

According to the embodiment described above, it is possible to form a stereoscopic image in such a manner that a print image is read, information in an area for recognition is converted into braille characters, and a blank form having a nature that the volume thereof is increased irreversibly by expansion when heated is heated partially.

In the present embodiment, a case that a stereoscopic image is output directly by the present unit has been described, but it is similarly possible to transmit information in the data storage section 702 to another unit through a transmission control section 711 to output the same.

Figure 12:
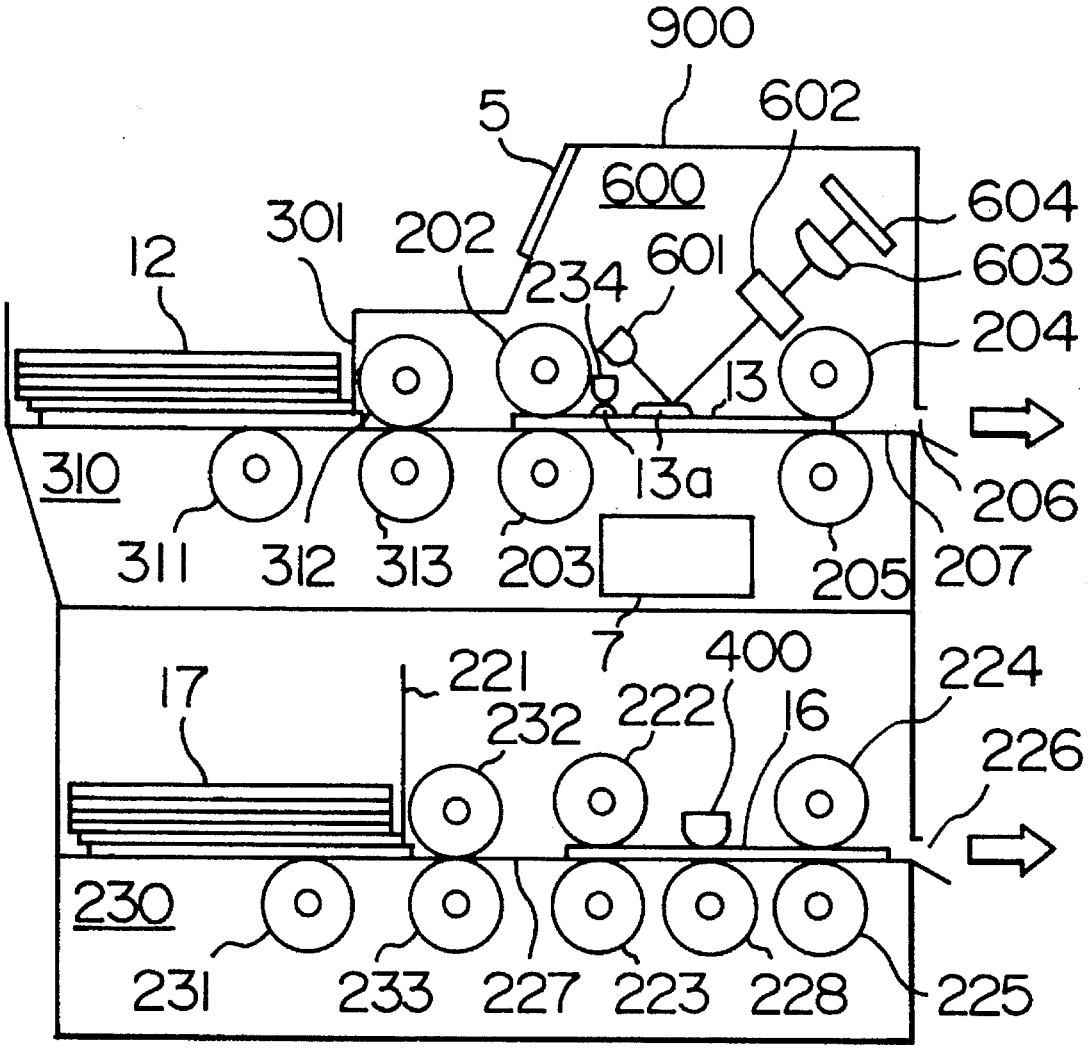
FIG. 12 is a sectional view showing an example of a conversion unit for converting a stereoscopic image into a print image according to the present invention.
Figure 13:
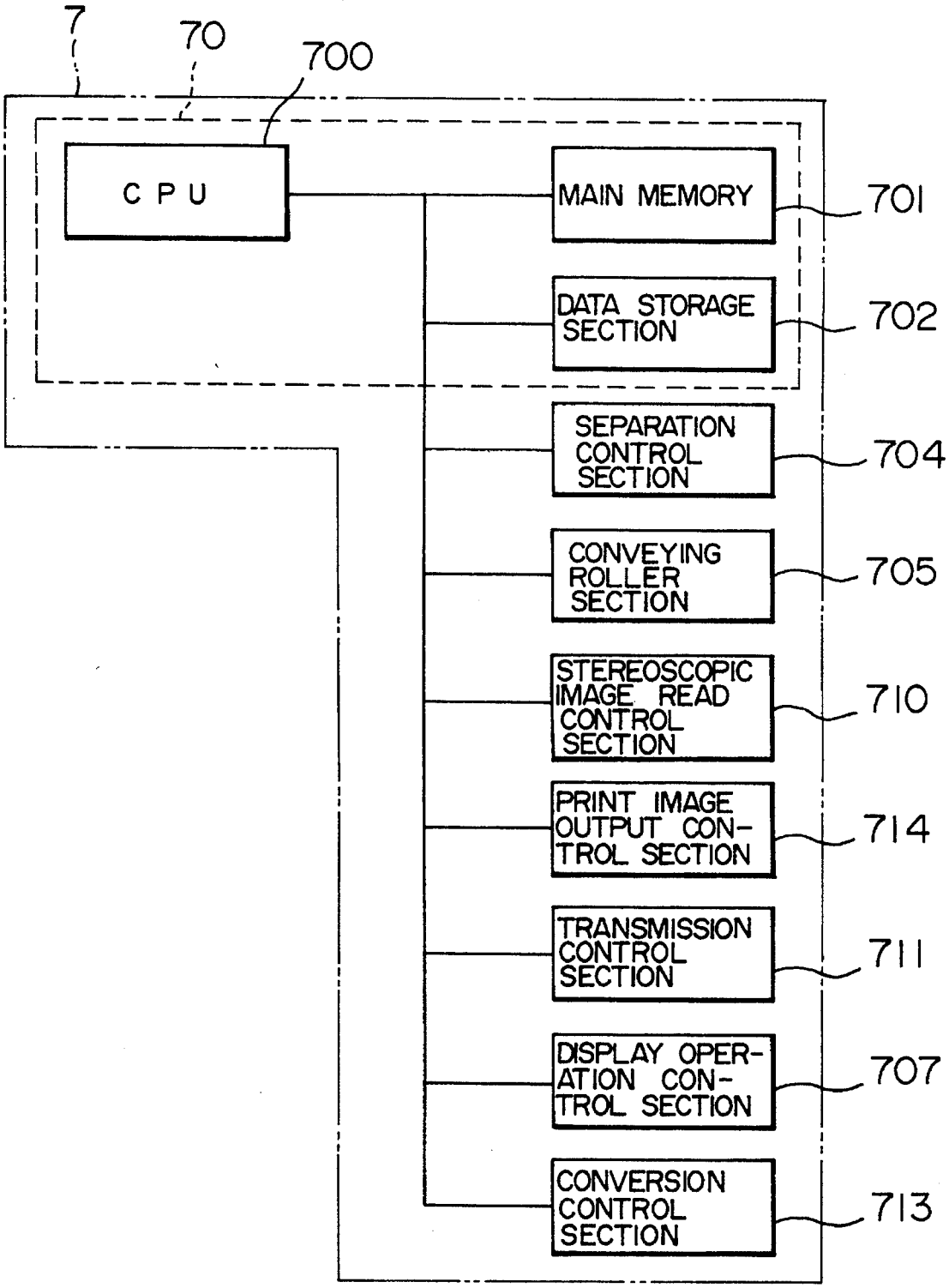
FIG. 13 is a block diagram showing an example of an information processing control section for controlling the conversion unit shown in FIG. 12.

Next, an embodiment of an input-output unit of a stereoscopic image for reading a stereoscopic image and outputting a print image will be described with reference to FIG. 12 and FIG. 13. FIG. 12 is a sectional view showing an example of a conversion unit for converting a stereoscopic image into a print image, and FIG. 13 is a block diagram of an example of an information processing control section for controlling the conversion unit shown in FIG. 12.

The structure of a conversion unit 900 shown in FIG. 12 will be described. A case that a print image is printed on a blank form will be described, but the medium is not limited to a blank form.

In the conversion unit 900, there is provided a display operation section 5 for inputting directional display of operation for a user and information of the user.

First, a structure for reading a stereoscopic image will be described. A hopper 301 which is a housing section is provided for accumulating blank forms 12 on which a stereoscopic image is formed. In the hopper 301, there is provided a separating section 310 composed of a gate roller 312, a feed roller 313 and a pickup roller 311, so that the blank forms 12 in the hopper 301 may be taken out one sheet at a time. In the separating section 310, there is provided a second conveyance passage 207 which is a third conveying means having conveying rollers 202, 203, 204 and 205 for conveying a blank form 13 taken out of the hopper 301. Along the second conveyance passage 207, there is provided a detector sensor 234 for detecting a print format on the blank form 13 and a stereoscopic image reader section 600 for the purpose of reading a stereoscopic image formed on the blank form 13. Along the second conveyance passage 207, there is provided a blank form releasing port 206 on the opposite side of the separating section 310, so that the blank form complete with reading may be released. An example of the structure of the stereoscopic image reader section 600 being the same as the structure described with reference to FIG. 5, description thereof is omitted here.

FIG. 13 is a block diagram of an example of an information processing control section 7 for controlling the conversion unit 900. The information processing control section 7 is composed of a separation control section 704 for controlling separating sections 310 and 230 for separating blank forms 12 and 17 one sheet at a time from the respective hoppers 301 and 221, a conveying roller control section 705 for controlling conveying rollers 202, 203, 204 and 205 and conveying rollers 222, 223, 224 and 225, a read control section 710 for controlling a light source 601, a motor 606 and a sensor section 604 of the stereoscopic image reader section 600, a print head control section 714 for controlling a print image output section 400, a transmission control section 711 for controlling data communication with another unit, a display operation control section 707 for controlling the display operation section 5 for performing information display and operation input of the conversion unit, conversion means 713 for converting information in the area 11*a* for recognition among information on a read stereoscopic image into characters, and a control section 70 for performing overall control on respective control sections. The control section 70 is composed of a CPU 700, a main memory 701 and a data storage section 702 for storing data.

The operation of the conversion unit 900 will be described hereinafter. A user who utilizes the conversion unit 900 designates the type of a blank form to be used and the area for recognition in the blank form for reading a stereoscopic image and inputs start from the display operation section 5. By virtue of the start information, the separating section 310 and the conveying rollers 202, 203, 204 and 205 along the second conveyance passage 207 start, respectively, from the hopper 301 where the blank forms 12 on which a stereoscopic image is formed are housed by means of control signals of the separation control section 704 and the conveying roller control section 705. The separating section 310 starts, and one sheet of the blank forms 12 set in the hopper 301 is taken out and sent out to the second conveyance passage 207. The sent out blank form 13 is sent to the detector sensor 234 by means of the conveying rollers 202 and 203, and the area (not illustrated) for recognition is detected by means of the detector sensor 234. Further, when the blank form 13 is sent to the stereoscopic image reader section 600, a light source 601 is lighted by the control of a stereoscopic image read control section 710, a mirror 607 is driven by a motor 606 and set at a position where light is condensed by a lens 605 and reflected by the mirror 607 so as to form an image at the end portion of the blank form 13.

The image formed on the blank form 13 is focused on any of a plurality of sensor elements 604*m*, 604*n*, 604*o* or the like of the sensor section 604 by means of a first lens 602 and a second lens 603. When a read signal from the sensor section 604 is sent to the data storage section 702, the motor 606 is driven so as to rotate the mirror 607 thereby to shift the position of the image on the blank form 13, and that image is read by the sensor section 604 and sent to the data storage section 702 in the similar manner as above. When reading at the sensor section 604 is completed while the mirror 607 is thus rotated thereby to shift the image to the other end of a blank form 13, the motor 606 is driven in a reverse manner so as to read the image by traversing the mirror 607 in the reverse direction, which is performed on all over the blank form 13. Reading of a projection 13*a* on the blank form 13 will be described. When it is assumed that an image of a light source except the projection 13*a* of the blank form 13 is focused on a sensor element 604*n*, a signal detected from the sensor element 604*n* is stored in the data storage section 702 through the stereoscopic image read control section 710, and an image of a light source in the case of the projection 13*a* on the blank form 13 is detected by a sensor element other than the sensor element 604*n* in accordance with the height thereof, whereby the data thereof are stored in the data storage section 702. While the blank form 13 is being sent, the image on the blank form 13 is traversed by means of the mirror 607, this image is detected by the sensor section 604, and the detected signals are stored in the data storage section 702 consecutively, thus making it possible to read the unevenness on the blank form 13. The information which is detected to be the data in the area for recognition by the detector sensor 234 among the information stored in the data storage section 702 is converted into print characters by conversion means 713, which are stored in the data storage section 702 as the information on a print image together with the information in the area for no recognition. The blank form 13 having its stereoscopic image completely read is released through the blank form releasing port 206. The blank forms to be read are separated consecutively by means of the separating section 310, thus reading the information.

In order to output the information stored in the data storage section 702 as the information on a print image to a blank form as a print image, the separating section 230 and conveying rollers 222, 223, 224 and 225 along a fourth conveyance passage 227 start first, respectively, by means of control signals of the separation control section 704 and the conveying roller control section 705. The separating section 230 starts, and one sheet of the blank forms 17 set in the hopper 221 is taken out and sent out to the fourth conveyance passage 227. A sent out blank form 16 is sent to a print image output section 400 by means of the conveying rollers 222 and 223, where the information stored in a storage section 702 is printed on a blank form 16. The blank form on which a print image is thus printed is sent to the blank form releasing port 226 by means of the conveying rollers 224 and 225 and released to a user client.

According to the embodiment described above, it is possible to read a stereoscopic image, convert information in an area for recognition into characters, and print a print image on a blank form.

Although a case that a print image is output directly by the present unit has been described in the present embodiment, it is also possible to transmit the information in the data storage section 702 to another unit through the transmission control section 711 to output the same.

According to the foregoing, it is possible to read a print image and output the same after converting it into a stereoscopic image, or conversely, read a stereoscopic image and output the same after converting it into a print image. It is also possible to transmit the read information and output the same to another unit after conversion.

In the above-described embodiment, a user can select an image output freely among the outputs from an information unit by providing selecting means for selecting either a stereoscopic image output or a print image output. In this case, there is provided in the unit a display operation section for inputting directional display of operation for a user and information of the user. Further, as a medium, for example, a blank form is one in accordance with the selection of the image output, which is a blank form having a nature that the volume thereof increases irreversibly by expansion when heated when a stereoscopic image is output and a blank form of a print medium when a print image is output.

Further, it is possible to output a print image and a stereoscopic image with one head by controlling the heating temperature applied to a print head for outputting a print image on a blank form.

According to the present embodiment, by varying a heating temperature applied to one printing head, it is possible to form a stereoscopic image by partially heating a blank form having a nature that the volume thereof increases irreversibly by expansion when heated or output a print image on a blank form.

Many different embodiments of the present invention may be constructed without departing from the spirit and scope of the invention. It should be understood that the present invention is not limited to the specific embodiments described in this specification. To the contrary, the present invention is intended to cover various modifications and equivalent arrangements included within the spirit and scope of the claims.

We claim:

1. A stereoscopic image processing system, comprising:

a hopper for stacking a medium having a nature that a volume thereof expands irreversibly when heated;

means for individually separating and fetching said medium stacked in said hopper;

first conveying means for conveying said medium fetched by said separating and fetching means;

heating means for heating said medium, said heating means including a plurality of heating cells each having a size of a print character;

pressing means for pressing said medium against said heating means to thereby form a stereoscopic image on said medium; and information processing control means for processing information of said respective means and controlling operation thereof.

2. A stereoscopic image processing system according to claim 1, further comprising:

second conveying means for conveying a print medium; and print image reading means for reading a print image printed on said print medium.

3. A stereoscopic image processing system according to claim 2, wherein said stereoscopic image processing system further includes transmission means for exchanging information with another unit.

4. A stereoscopic image processing system according to claim 1, further comprising:

second conveying means for conveying a print medium;

print image recording means for reading a print image printed on said print medium; and braille character conversion means for recognizing character information from said print image reading means and converting the same into braille character information.

5. A stereoscopic image processing system, comprising:

second conveying means for conveying a medium on which a stereoscopic image is formed;

stereoscopic image reading means for reading any unevenness on the stereoscopic image formed on the medium; and information processing control means for processing information of said respective means and controlling operation thereof.

6. A stereoscopic image processing system according to claim 5, wherein said stereoscopic image reading means includes:

a light emitting section having a light source, a lens for forming an image of the light source on the medium, and a mirror driven by a motor for traversing the image of the light source on the medium;

optical means, having at least two cylindrical lenses at right angles to each other, for forming an image; and a sensor section for reading an image formed by said optical means and converting the read image into electric signals.

7. A stereoscopic image processing system, comprising:

a housing section for housing media having a nature that a volume thereof expands when heated;

first conveying means for conveying a medium taken out of said housing section;

stereoscopic image output means having heating means and pressing means for pressing the medium against said heating means, in which the medium is partially heated so as to form a stereoscopic image;

second conveying means for conveying the medium on which the stereoscopic image is formed;

stereoscopic image reading means for reading any unevenness of the stereoscopic image formed on the medium by said second conveying means; and information processing control means for processing information of said respective means and controlling operation thereof.

8. A stereoscopic image processing system, comprising:

a housing section for housing media having a nature that a volume thereof expands irreversibly when heated;

first conveying means for conveying a medium taken out of said housing section;

stereoscopic image output means having heating means and pressing means for pressing the medium against said heating means, in which the medium is heated so as to form a stereoscopic image;

second conveying means for conveying the medium on which a stereoscopic image is formed;

stereoscopic image reading means for reading any unevenness of a stereoscopic image formed on the medium, said stereoscopic image reading means including a light emitting section having a light source, a lens for forming an image of the light source on the medium, and a mirror driven by a motor for traversing the image of the light source on the medium, optical means having at least two cylindrical lenses at right angles to each other for forming an image, and a sensor section for reading an image formed by the optical means and converting the image into electric signals;

information processing control means for processing information of said respective means and controlling operation thereof;

transmitting means for exchanging information with another unit; and means for inputting information of an operator to said information processing control means.

9. A stereoscopic image processing system, comprising:

stereoscopic image output means for heating a medium having a nature that the volume thereof expands irreversibly when heated, to thereby form a stereoscopic image;

stereoscopic image reading means for reading any unevenness on the stereoscopic image formed on the medium, and information processing control means for processing information of said respective means and controlling operation thereof.

10. A stereoscopic image processing system, comprising:

a first hopper for stacking a medium having a nature that a volume thereof expands irreversibly when heated;

means for individually separating and fetching said medium stacked in said first hopper;

first conveying means for conveying said medium fetched by said separating and fetching means;

heating means for heating said medium, said heating means including a plurality of heating cells each having a size of a print character;

pressing means for pressing said medium against said heating means to thereby form a stereoscopic image on said medium;

second conveying means for conveying the medium on which the stereoscopic image is formed;

stereoscopic image reading means for reading any unevenness on the stereoscopic image formed on the medium; and information processing control means for processing information of respective means and controlling operation thereof.

* * * * *